United States Patent [19]

Allen

[11] 4,326,181

[45] Apr. 20, 1982

[54] HIGH VOLTAGE WINDING FOR DRY TYPE TRANSFORMER

[75] Inventor: Benjamin F. Allen, Rome, Ga.

[73] Assignee: General Electric Company

[21] Appl. No.: 120,245

[22] Filed: Feb. 11, 1980

Related U.S. Application Data

[63] Continuation of Ser. No. 852,795, Nov. 18, 1977, abandoned.

[51] Int. Cl.[3] ..... H01C 33/00

[52] U.S. Cl. ..... 336/12; 29/602 R; 336/180

[58] Field of Search ..... 323/44 R, 48, 49; 336/5, 10, 12, 69, 70, 180, 182, 150; 29/602 R, 605, 606

[56] References Cited

U.S. PATENT DOCUMENTS

| | | | |
|---|---|---|---|
| 1,412,782 | 4/1922 | Dwyer | 336/5 |
| 1,504,276 | 8/1924 | Sharkelton | 336/182 X |
| 2,374,029 | 4/1945 | Moslin | 336/12 |
| 2,384,799 | 9/1945 | Cook | 336/182 X |
| 2,987,684 | 6/1961 | Doucette, Jr. | 336/182 X |
| 3,348,179 | 10/1967 | Veitch | 336/70 X |
| 3,702,451 | 11/1972 | Hofing | 336/70 X |

FOREIGN PATENT DOCUMENTS

| | | | |
|---|---|---|---|
| 716496 | 12/1931 | France | 336/180 |
| 491845 | 9/1938 | United Kingdom | 336/70 |

*Primary Examiner*—Thomas J. Kozma
*Attorney, Agent, or Firm*—Richard A. Menelly

[57] ABSTRACT

A compact air cooled transformer employs multisection, multilayered high voltage coils in a wye connection to substantially reduce the spacing required between the high voltage coil and low voltage coil and between the ends of the high voltage coil and the transformer core yokes and coil support structure.

2 Claims, 10 Drawing Figures

HIGH VOLTAGE WINDING FOR DRY TYPE TRANSFORMER

This is a continuation of application Ser. No. 852,795 filed on Nov. 18, 1977, now abandoned.

BACKGROUND OF THE INVENTION

High voltage transformers of the type mounted within a ventilated casing and cooled either by ambient air flow or by forced ventilation generally require relatively large physical spacings to ensure that the high voltage windings do not short circuit to the core and winding support structure. To provide adequate high voltage coil spacing a distance of from 10 to 12 inches or more is generally required at each end.

Transformers currently employing voltages less than 23 kilovolts are generally wound in a delta type arrangement. When materials, economy and overall space must be maintained at a minimum, wye connections are more feasible for voltage applications of 23 Kv and greater.

The purpose of the invention is to provide methods and apparatus for manufacturing dry type, air cooled transformers having a substantially reduced core and coil size.

SUMMARY OF THE INVENTION

Dry type air cooled transformers are manufactured by providing a plurality of layer type windings on a continuous core in a wye connection having a grounded neutral.

The multi-layer coil is arranged such that the extremities of the coil are at neutral potential and the coil center section provides the high voltage line terminals. The neutral terminals are located relative to the extremities of the vertical core dimension to provide a minimum space requirement between the ends of the coils and the transformer core and the coil support structure.

DESCRIPTION OF THE PREFERRED EMBODIMENT

Figure 1:
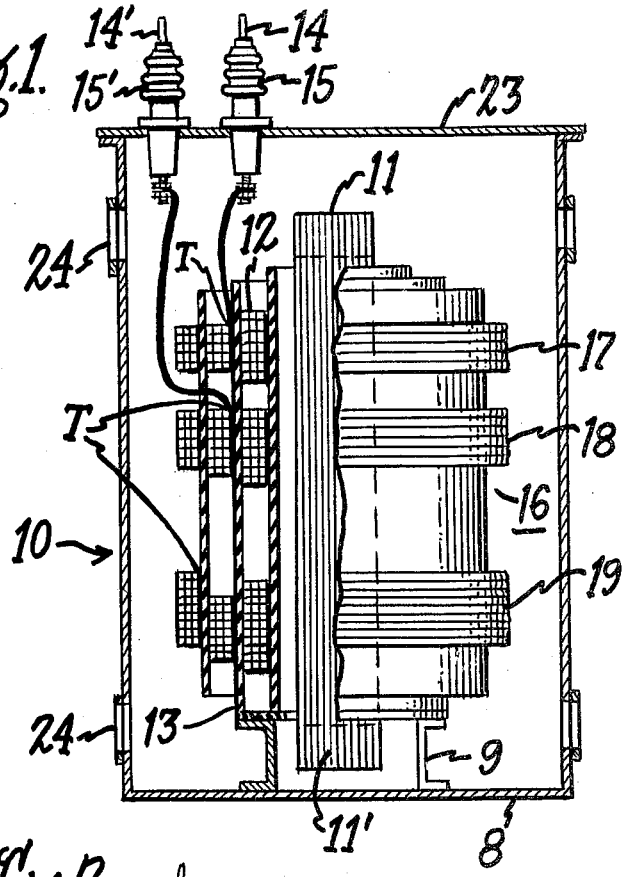
FIG. 1 is a cutaway perspective of the compact high voltage dry type transformer according to the invention.

The compact dry type high voltage transformer of the invention can be seen by referring to FIG. 1 where the transformer 10 consists basically of a core 11 centrally disposed within a low voltage winding 12. A tube 13 of electrically insulating material surrounds the low voltage winding 12 and serves to support the high voltage winding generally described as 16. For the purpose of this disclosure the terms "coil" and "winding" are considered synonymous. The high voltage winding 16 consists of a plurality of layers of wire and a plurality of sections such as the first section 17, second section 18 and third section 19. Connections to each of the individual sections (17, 18, 19) are made by means of plurality of taps T. Connection to taps T is made through a pair of insulating bushings 15, 15' to external leads 14, 14'. The core 11 containing the aforementioned structure is rigidly connected to a base member 8 by means of supporting legs 9. Access to cooling air is made by providing a plurality of ventilating openings 24 in the casing 23 which provides environmental protection to the transformer 10.

Figure 3:
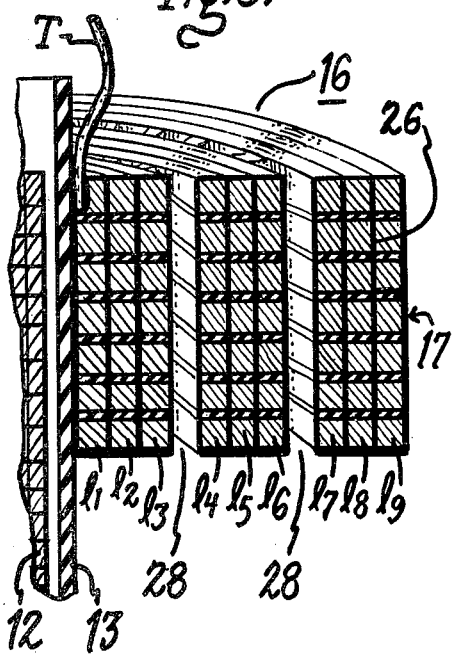
FIG. 3 is an enlarged sectional view of nine layers of windings arranged around the perimeter of the tube of FIG. 2.
Figure 2:
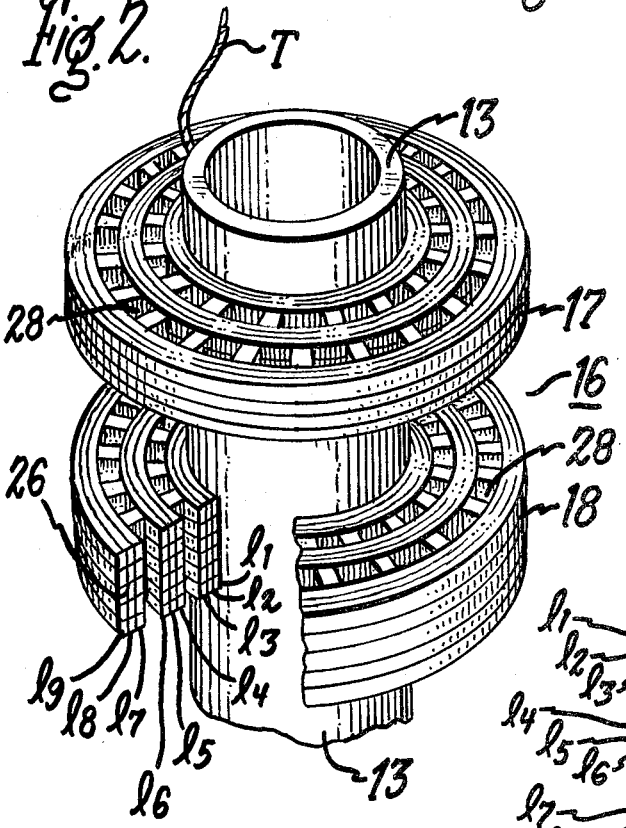
FIG. 2 is a top perspective view of the high voltage coil and tube for use within the transformer of FIG. 1.

For providing compact dimensions to the transformer 10 of FIG. 1, the tube 13 is wound with the high voltage winding 16 in a particular manner as can be seen by reference to FIG. 2. The high voltage winding 16 is arranged around the perimeter of tube 13 in an odd number of layers so that electrical access can be made to the winding 16 by means of tap T located at the upper extremity of tube 13. The requirement that the layers provided in an odd number can be seen by referring to FIG. 3. Here the first section 17 is shown in an enlarged sectional view where the electrical tap T is connected to a first layer $1_1$. First section 17 is to be connected to the next section 18 by interconnecting the ninth layer $1_9$ of section 17 with the first layer $1_1$ of section 18. The particular arrangement of odd number of layers ($1_1$–$1_9$) for example is chosen to ensure that the last connecting lead is distal from the top end of tube 13. As is common with multi layer transformer windings, a plurality of layers of insulation 26 is provided between each of the individual layers to ensure adequate electrical insulation between layers.

Figure 4:
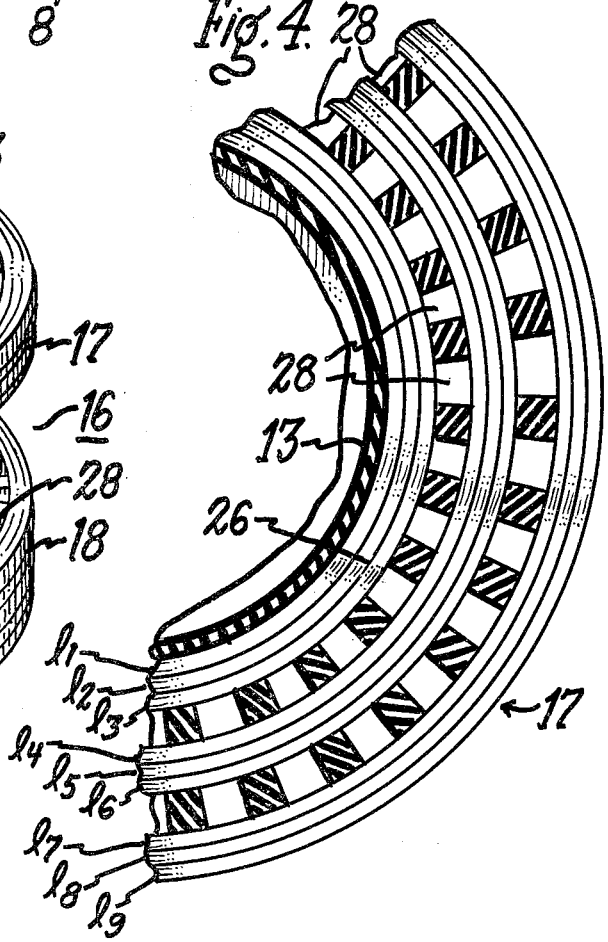
FIG. 4 is a cross section plan view of the coil of FIG. 3 containing nine layers of windings.

To ensure an adequate flow of coolant between the individual layers a plurality of cooling ducts 28 is also provided as shown in FIG. 4. The cooling ducts 28 are provided in such a manner as to define a continuous path from the bottom to the top of the coil 16.

Figure 5:
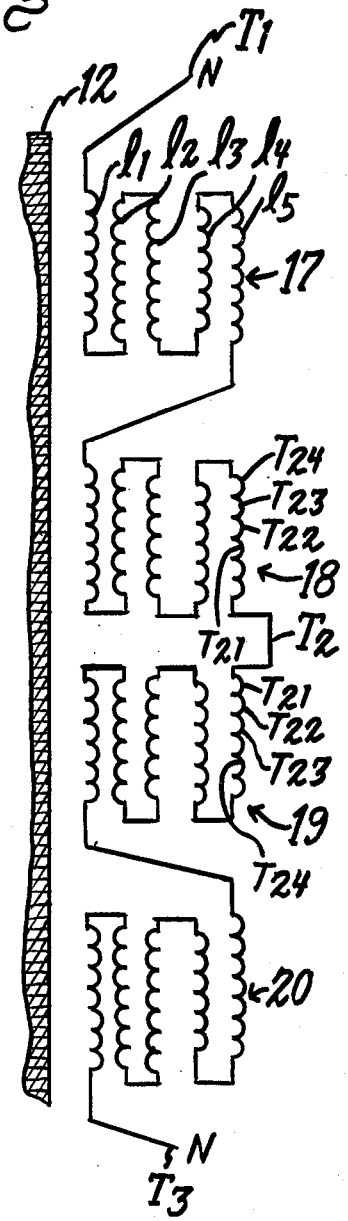
FIG. 5 is a schematic representation of a method of arranging windings for the transformer of the invention with the neutral terminal coil leads proximate the core yokes.

FIG. 5 shows one arrangement for providing the compact transformer winding of the invention. The arrangement of FIG. 5 has four individual section 17–20, each containing 5 layers ($1_1$–$1_5$) for example, arranged so that the top terminal $T_1$ is proximate to the end of the low voltage winding 12, and the third terminal $T_3$ is proximate to the other end of the aforementioned low voltage winding 12. The arrangement of FIG. 5 represents one of three like phases for a three phase transformer or a single phase winding in the case of a single phase transformer. Between the individual sections 17–20, there is both an operating voltage stress and an impulse voltage stress. The top terminal $T_1$ and the bottom terminal $T_3$ are at neutral potential, and the center terminal $T_2$ is at line potential. This arrangement allows the distance between the electrically neutral ends of the high voltage transformer winding 16 to be at a minimum distance from the top and bottom core yokes 11 which are electrically grounded. Taps $T_{21}$–$T_{24}$ are the high voltage connections for other tap voltage ratings and can be located proximate the center of the high voltage windings 16 or proximate the ends thereof.

Figure 6:
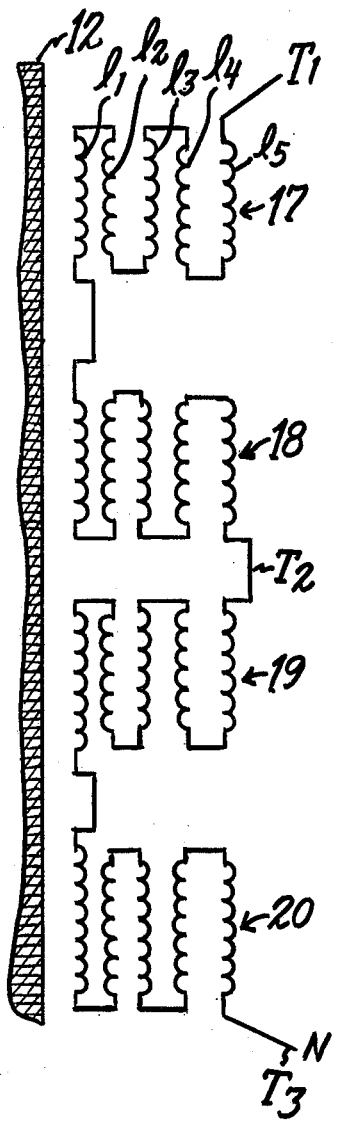
FIG. 6 is an alternate method for arranging the windings for the transformer of the invention.

Another arrangement for the compact transformer windings of the invention is shown in FIG. 6. The arrangement of FIG. 6 is similar to the embodiment of FIG. 5 except that the individual sections 17–20 have inside connections in contrast to the inside-outside connections of FIG. 5. Electrical connections can be made with the terminals $T_1$–$T_3$ which are all outside whereas the end terminals $T_1$ and $T_3$ for embodiment of FIG. 1 are "outside".

Figure 7:
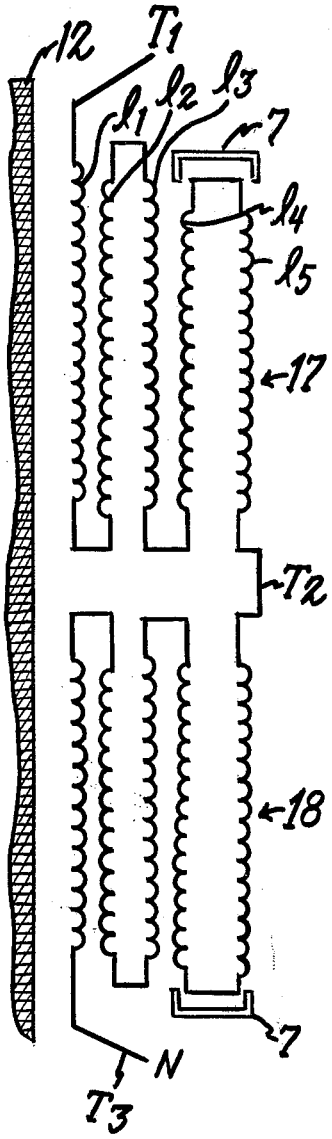
FIG. 7 is one schematic arrangement of the windings for the transformer of the invention containing two sections of windings with an odd number of layers of winding per section.

Another arrangement for the windings of the compact transformer of the invention shown in FIG. 7, consists of two sections 17 and 18. The operating voltage and the impulse voltage stress between the section 17, 18, of high voltage winding 16 and the low voltage winding 12 is low. However, with this arrangement insulating collars 7 have to be provided at the ends of the outer layers $\mathbf{1}_4$ and $\mathbf{1}_5$ to permit a minimum separation distance between the ends of the high voltage winding 16 and the yokes 11. Although five layers ($\mathbf{1}_1$–$\mathbf{1}_5$) are shown for each section 17, 18, a large number of layers ($\mathbf{1}_1$–$\mathbf{1}_n$) is generally required with this particular arrangement to keep the operating voltage stress between each of the individual layers ($\mathbf{1}_1$–$\mathbf{1}_n$) within the allowable values. As with the embodiments of FIGS. 5 and 6 the total number of layers ($\mathbf{1}_1$–$\mathbf{1}_n$) must be kept at an odd number in order to ensure that the connections between the individual sections 17, 18 are in the same direction for the reasons described earlier.

Figure 8:
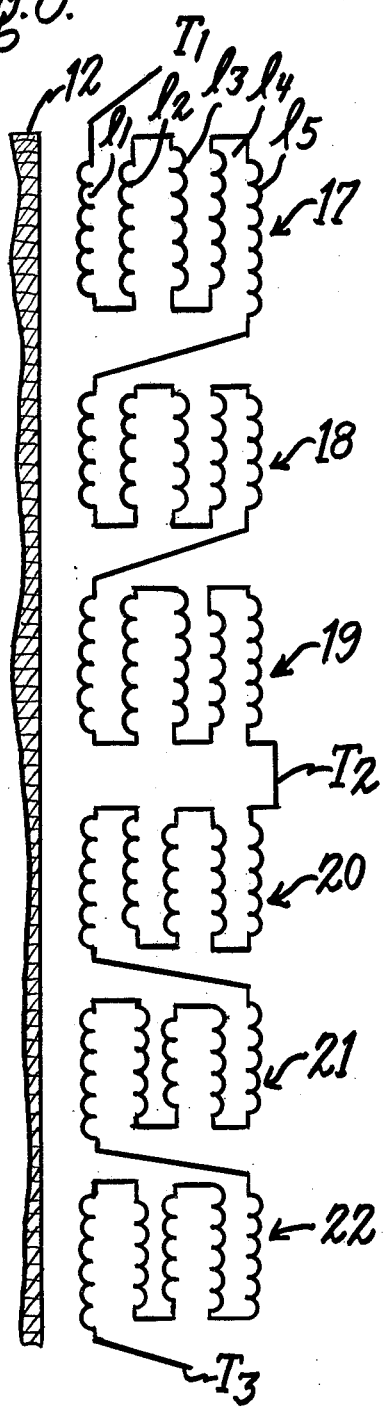
FIG. 8 is one schematic arrangement of the windings for the transformer of the invention having six sections containing an odd number of layers per section with the individual sections interconnected in a first configuration.
Figure 10:
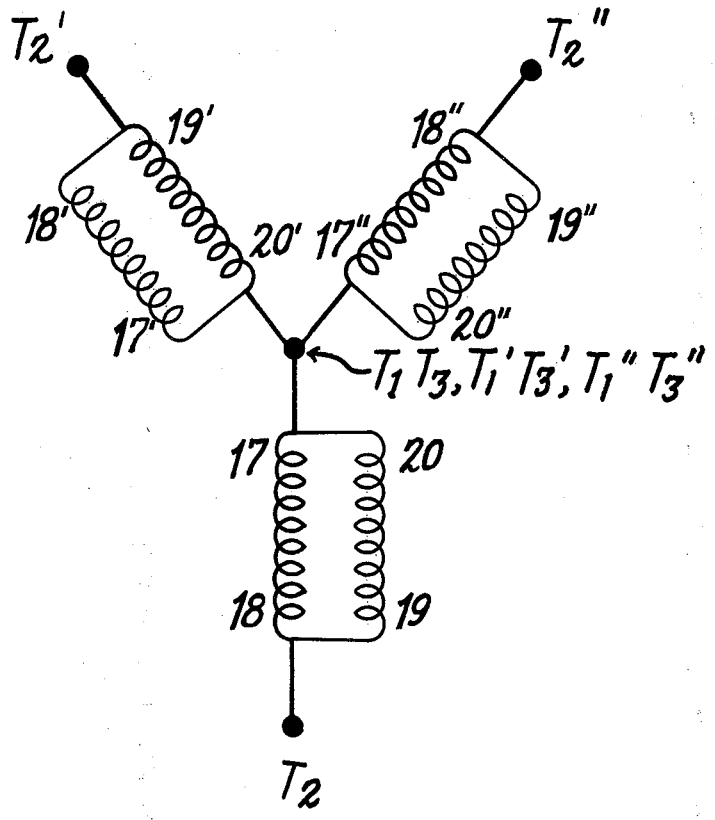
FIG. 10 is a diagrammatic representation of the winding arrangement of FIG. 5 in a wye connection.

The arrangement of FIG. 8 is similar to that of FIG. 5 with the addition of two extra sections 21 and 22. The extra sections 21 and 22 reduce the operating voltage stress between the individual layers $\mathbf{1}_1$–$\mathbf{1}_5$ and improve the impulse voltage distribution but is more expensive to manufacture in view of increased labor and material costs to provide the extra sections. The individual sections 17–22, operate in a similar manner as described earlier for the individual sections 17–20. When the arrangement of FIG. 5 is used in a three-phase assembly each of the individual phases having line terminals $T_2$, $T_2'$, and $T_2''$ respectively, and neutral terminals $T_1$, $T_3$, $T_1'$, $T_3$, $T_1''$, $T_3''$ respectively are interconnected in the wye configuration shown in FIG. 10. The individual sections in each phase being designated 17–20, 17′–20′ and 17″–20″.

Figure 9:
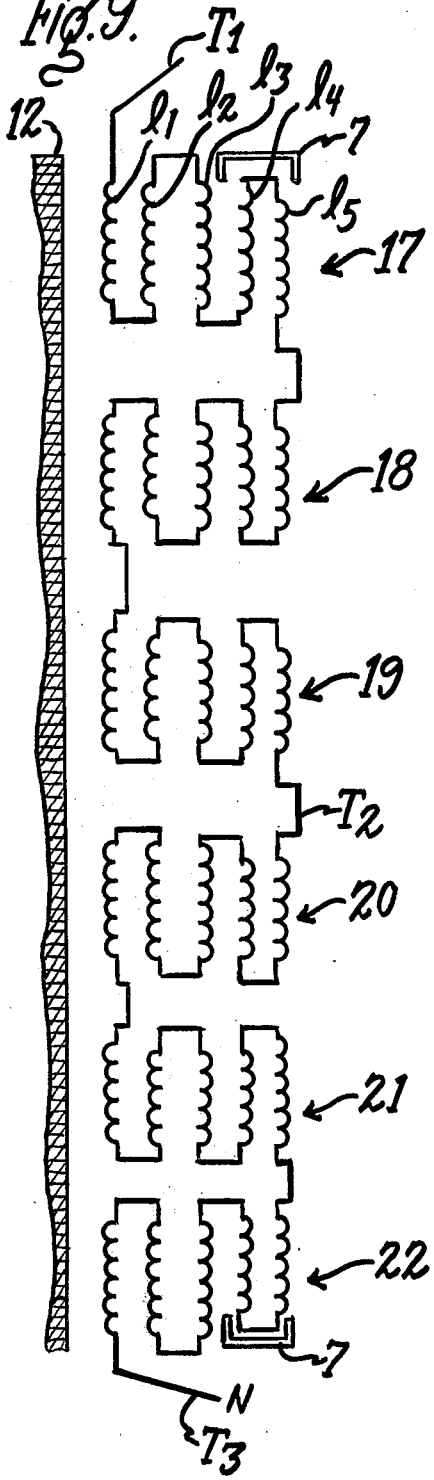
FIG. 9 is a schematic arrangement of the windings for the transformer of the invention having the same number of layers and sections as the embodiment of FIG. 8 with the sections interconnected by a different arrangement.

A further winding arrangement for the compact transformer of the invention is shown in FIG. 9. The arrangement of FIG. 9 is similar to the arrangement described earlier for FIG. 6. Two extra sections 21,22 are provided to reduce the operating voltage stress between the individual layers $\mathbf{1}_1$–$\mathbf{1}_5$ and to improve the impulse voltage distribution.

The compact high voltage transformer arrangement of the invention is described for dry type transformers wherein air is provided as the coolant. This is by way of example only, since the novel winding arrangement for providing compact transformers applies equally well to other type coolants such as condensible and noncondensible gases and dielectric fluids.

I claim:

1. A compact high voltage transformer of the type having three coil assemblies each of which consists of a low voltage coil concentrically arranged around a core and a high voltage coil, the high voltage coil comprising:

a multisectional coil having five layers of wire in each of four coil sections, the high voltage coils being arranged in an electrical wye connection on a coil support with a last layer of one section being electrically connected with a first layer of another section, said four coil sections consisting of a first pair of coils connected in series and a second pair of coils connected in series, said first and second coil pairs being electrically connected in parallel;

a top terminal connection proximate a top core yoke;

a bottom terminal connection proximate a bottom core yoke; and a plurality of terminal connections intermediate the high voltage coil to provide electrical connection to each of said pairs of coil sections for providing reduced spacing between said high voltage coil and said low voltage coil and between said high voltage coil and said coil support and said top and bottom core yokes.

2. A method of providing a three phase wye connected compact high voltage transformer winding comprising the steps of:

arranging a low voltage coil winding concentrically around a transformer core having core yokes for each of said three phases;

winding a high voltage coil consisting of five wire layers in each of four coil sections around said low voltage coil for each of said three phases;

connecting a first pair of said coil sections in series;

connecting a second pair of said coil sections in series;

connecting said first and said second pairs of coil sections in parallel within each of said three phases;

providing a terminal connection at both ends of each of said three phases; and connecting said terminal connections from each of said three phases to a common point for providing a common voltage terminal.

* * * * *